US011801543B2

(12) United States Patent
Täuber

(10) Patent No.: US 11,801,543 B2
(45) Date of Patent: Oct. 31, 2023

(54) REVERSING REEL AND METHOD OF OPERATING A REVERSING REEL

(71) Applicant: SMS group GmbH, Düsseldorf (DE)

(72) Inventor: Dirk Täuber, Netphen (DE)

(73) Assignee: SMS group GmbH, Düsseldorf (DE)

( * ) Notice: Subject to any disclaimer, the term of this patent is extended or adjusted under 35 U.S.C. 154(b) by 366 days.

(21) Appl. No.: 17/422,776

(22) PCT Filed: Jan. 13, 2020

(86) PCT No.: PCT/EP2020/050672

§ 371 (c)(1),
(2) Date: Jul. 14, 2021

(87) PCT Pub. No.: WO2020/148225

PCT Pub. Date: Jul. 23, 2020

(65) Prior Publication Data

US 2022/0080485 A1 Mar. 17, 2022

(30) Foreign Application Priority Data

Jan. 17, 2019 (DE) ..... 10 2019 200 594.2
May 14, 2019 (DE) ..... 10 2019 206 951.7

(51) Int. Cl.
*B21C 47/02* (2006.01)
*B21C 47/24* (2006.01)
(Continued)

(52) U.S. Cl.
CPC ..... *B21C 47/02* (2013.01); *B21C 47/245* (2013.01); *B65H 18/028* (2013.01);
(Continued)

(58) Field of Classification Search
None
See application file for complete search history.

(56) References Cited

U.S. PATENT DOCUMENTS 2,207,832 A * 7/1940 Spellacy ..... B21C 47/063 72/155
3,112,087 A * 11/1963 Fornataro ..... B21C 47/066 100/88

(Continued)

FOREIGN PATENT DOCUMENTS

CN 1264324 A 8/2000
CN 1547516 A 11/2004

(Continued)

*Primary Examiner* — William A. Rivera
(74) *Attorney, Agent, or Firm* — Smartpat PLC

(57) ABSTRACT

A reversing reel includes a rotor, on which a reel mandrel with a rotary drive for winding strip into a coil is eccentrically arranged. A driven mandrel support device includes a mandrel support that has a bearing head for supporting a free end of the reel mandrel. The bearing head is movable with the reel mandrel when the reel mandrel is transferred from an initial-winding position into a final-winding position. The mandrel support is a first piston-cylinder arrangement, and the mandrel support is supported in a pivotable manner via a mandrel-support bearing on a slide that is movable tangentially to a circular path of the reel mandrel. The inclination of the mandrel support and the position of the bearing head are adjustable such that the mandrel support is oriented in accordance with a resultant force from the weight force of the coil and the tensile force on the strip.

13 Claims, 3 Drawing Sheets

(51) Int. Cl.
*B65H 18/02* (2006.01)
*B21C 47/00* (2006.01)

(52) U.S. Cl.
CPC ..... *B65H 18/0212* (2020.08); *B21C 47/006* (2013.01); *B65H 2301/41344* (2013.01)

(56) References Cited

U.S. PATENT DOCUMENTS 3,580,018 A * 5/1971 Gott ..... B21C 47/326 72/426
3,963,187 A * 6/1976 Ohi ..... B65H 16/021 242/594.6
4,153,215 A * 5/1979 Schulze ..... B65H 19/26 242/532.2
4,343,440 A * 8/1982 Engl ..... B65H 18/26 242/547
4,524,919 A * 6/1985 Wehrmann ..... B65H 18/0212 242/541.5
4,867,387 A * 9/1989 Schonmeier ..... B65H 18/26 242/541.6
5,029,762 A * 7/1991 Behrens ..... B65H 54/72 242/474.5
5,100,072 A * 3/1992 Behrens ..... B65H 54/52 242/474.5
5,219,125 A * 6/1993 Rigg ..... B65H 65/00 242/487.7
5,308,008 A * 5/1994 Ruegg ..... B65H 18/26 242/541.7
5,429,320 A 7/1995 Pack
5,526,995 A * 6/1996 Westrich ..... B65H 67/0405 242/474.5
5,934,602 A * 8/1999 Jendroska ..... B65H 19/2215 242/598.1
5,957,404 A * 9/1999 Frampton ..... B21C 47/063 242/547
6,070,827 A * 6/2000 Spahlinger ..... B65H 65/00 242/475.7
6,109,559 A * 8/2000 Dorfel ..... B65H 18/26 242/541.5
6,161,790 A * 12/2000 Westrich ..... B65H 67/048 242/474.6
6,390,408 B1 * 5/2002 Madrzak ..... B65H 19/2261 242/541.6
6,502,445 B1 1/2003 Drigani et al.
10,017,347 B2 * 7/2018 Peccetti ..... B65H 19/2207
2004/0232272 A1 11/2004 Leisten
2015/0307304 A1 10/2015 Hoffmann et al.

FOREIGN PATENT DOCUMENTS

| | | | |
|---|---|---|---|
| CN | 203781487 | U | 8/2014 |
| CN | 104955752 | A | 9/2015 |
| DE | 4232363 | C2 | 11/1995 |
| EP | 1886951 | A1 | 2/2008 |
| JP | S59149256 | A | 8/1984 |
| JP | S61229756 | A | 10/1986 |
| JP | S645625 | U | 1/1989 |
| JP | 105104136 | A | 4/1993 |
| JP | H06297034 | A | 10/1994 |
| JP | 2017517461 | A | 6/2017 |
| KR | 100797293 | B1 | 1/2008 |
| WO | 2013117351 | A1 | 8/2013 |
| WO | 2018041673 | A1 | 3/2018 |

* cited by examiner

REVERSING REEL AND METHOD OF OPERATING A REVERSING REEL

CROSS-REFERENCE TO RELATED APPLICATION

This application is a national stage application, filed under 35 U.S.C. § 371, of International Patent Application No. PCT/EP2020/050672, filed on 13 Jan. 2020, which claims the benefit of German Patent Applications No. 10 2019 200 594.2, filed 17 Jan. 2019 and No. 10 2019 206 951.7 filed 14 May 2019.

TECHNICAL FIELD

The disclosure relates to a reversing reel with a rotor, on which at least one reel mandrel is provided with a rotary drive and arranged eccentrically with respect to an axis of rotation of the rotor, for winding a strip into a coil, having at least one driven mandrel support device comprising a mandrel support that has a bearing head for supporting the free end of the at least one reel mandrel.

The disclosure further relates to a method for winding strips, in particular metal strips, into a coil, in particular using the disclosed reversing reel.

BACKGROUND

In principle, reels are known in the prior art. These are used, for example, in both cold and hot strip rolling mills for winding the strip.

After rolling, for example, a rolled metal strip can be wound onto a reel mandrel or onto a winding sleeve fitted onto the reel mandrel and later unwound again. For the realization of shortest winding coil sequences, especially in so-called "continuous operation," reversing reels that have at least two reel mandrels and in which the positions of the reel mandrels are changed during a reeling process are used. The reel mandrels are each driven and mounted on a rotor. At the start of a winding process, the rotor of the reel is turned such that a reel mandrel that is still empty is positioned in an initial-winding position. In such position, the strip is then wound on the reel mandrel. The term "initial winding" is usually understood to mean that one to three windings of the strip are initially wound onto the reel mandrel. After initial winding has taken place, a tensile stress (strip tension) is built up in the strip for further winding. During further winding, the reel mandrel is turned from the initial-winding position to a final-winding position. There, the final winding of the strip into a coil or a bundle, as the case may be, takes place. The coil can be removed from the final-winding position after completion and transported further.

In a reversing reel, the reel mandrels are mounted in a fixed manner on one side, that is, on one end on the drive side. However, when reeling a metal strip, it is important to support the reel mandrel on both sides and to have a symmetrical bending line of the reel mandrel as a result, in order to ensure stable strip running during reeling and to improve the winding accuracy of the strip on the reel mandrel.

From WO 2018/041673 A1, a support device for a reversing reel for reeling a metal strip is known, which comprises at least one support unit that can be brought into supporting contact with a free end section of a reel mandrel. The support unit is guided on a rail, which is arranged in front of the reel and which follows the circular path of the reel mandrel with its own drive. The guide rail in front of the reel obscures the area on the operating side in front of the reel. In addition, the complete execution is relatively heavy and costly.

From EP 1 886 951 A1, a winding machine is known for winding a web of material divided into strips by longitudinal cuts, in particular a paper web, plastic film or metal foil. The winding machine comprises two winding shafts extending across the width of the machine, which are mounted in a swiveling turning device on one side of the machine for movement from a winding position to an unloading position and back. On the side of the machine opposite to the turning device, there is a support device with a support element that can be moved vertically by means of a drive and whose end supports a winding shaft on its way from the initial-winding position to the unloading position. The support element is formed as a motor-driven extendable support, which is mounted as a swing arm in a swivel joint. The support element can thus be pivoted from a winding position to an unloading position, wherein the pivoting is effected by means of an actuator, such that the pivoting movement describes a circular path that corresponds to the circular path of the turning device. In the winding machine described in EP 1 886 951 A1, a winding process is not provided during the movement of the turning device under strip tension. Rather, it is intended to carry out the winding process into the initial-winding position and then to rotate the winding roll concerned to the unloading position.

Relatively high coil weights have to be handled, in particular when winding metal strips from rolling mills. The reel mandrel already has a very high dead weight. Therefore, its free end is already sagging opposite its rotor-side end when it is not wound with a metal strip. Under the load of the wound metal strip, the one-sided deformation increases. In addition, there is the effect of the strip tension of the metal strip wound up under tensile force. The sagging or drooping of the free end of the reel mandrel is particularly disadvantageous, because the winding accuracy of the strip is impaired. This winding inaccuracy also has a negative effect on the flatness of the strip.

SUMMARY

The disclosure aims to improve a known reversing reel in such a manner that the deflection of the free end of the reel mandrel is reliably reduced during the entire winding process. The disclosure is further based on the object of providing a corresponding method.

The object is achieved by a device as claimed. The object is further achieved by a method as claimed.

A reel with a rotor is provided, on which at least one reel mandrel with a rotary drive for winding strip into a coil is arranged eccentrically with respect to an axis of rotation of the rotor. The reel has at least one driven mandrel support device, comprising a mandrel support, which has a bearing head for supporting a free end of the at least one reel mandrel. In accordance with a variable position of the reel mandrel the bearing head is movable with the reel mandrel when the reel mandrel is transferred from an initial-winding position into a final-winding position. The mandrel support is in the form of a first piston-cylinder arrangement and the mandrel support is supported in a pivotable manner via a mandrel-support bearing on a slide that is movable tangentially to a circular path of the reel mandrel. The inclination of the mandrel support and the position of the bearing head are adjustable such that the mandrel support is oriented in accordance with or parallel to a resultant force from weight force of the coil and tensile force on the strip.

The position of the bearing head is preferably radially adjustable with respect to the axis of rotation of the rotor.

The disclosure can be summarized as providing a mandrel support device having a mandrel-support bearing that is traveling along, which supports the free end of the reel mandrel in an initial-winding position and during transfer of the reel mandrel from the initial-winding position into the final-winding position. The bearing head of the mandrel support device can be in engagement with the free end of the reel mandrel both during initial winding and intermittently during final winding, in such a manner that in a relatively simple manner the mandrel support counteracts not only the increasing weight force but also the strip tension force. The mandrel-support bearing can be adjusted in such a manner that a setting can be selected for any combination of strip tension and coil weight, even during the winding process, which allows the reel mandrel to be supported accordingly. The mandrel support is adjusted during the operation of the reversing reel in such a manner that the deflection of the reel mandrel can be optimally influenced. Ideally, the reel mandrel is always supported, even during rotation, approximately in the direction of the resultant force from the strip tension and the weight force of the bundle or coil, as the case may be. This has the particular advantage that no tilting torques are transmitted into the system that would have to be additionally absorbed.

"Traveling along" means that the mandrel support follows the executed circular movement of the reel mandrel and the coil wound thereon during the rotation of the rotor.

Preferably, the reversing reel additionally comprises a stationary outer bearing, which is pivoted against the reel mandrel in the final-winding position. Both the bearing head of the mandrel support device and a correspondingly formed bearing head of a stationary outer bearing are formed such that they can each engage a different circumferential section of the reel mandrel along the same length of the reel mandrel. This makes it possible to engage the reel mandrel with the stationary outer bearing in the final-winding position and then move the mandrel support device back to the starting position.

The reversing reel preferably comprises two reel mandrels, each rotatably mounted on one side of the rotor, which are arranged diametrically opposite each other.

Preferably, the mandrel support can be adjusted in inclination by means of an adjusting device fastened on the slide. In combination with the mandrel support, which can be adjusted in inclination and length, an inclination adjustment can be achieved particularly easily via the slide by superimposing a rotational movement and a linear movement.

Preferably, a second piston-cylinder arrangement is provided as the adjusting device for adjusting the inclination of the mandrel support. Both the first and the second piston-cylinder arrangements are preferably formed as hydraulic cylinders, whose force can be controlled relatively easily and finely. Both piston-cylinder arrangements can be equipped with sensors for force measurement and with sensors for path recording.

Alternatively, the inclination adjustment for the mandrel support can be accomplished by means of a hydraulic or electric rotary drive.

Preferably, the slide can be displaced tangentially to the axis of rotation of the rotor via a third piston-cylinder arrangement.

In the case of a level set-up of the reversing reel, the slide can be moved or displaced, as the case may be, horizontally with respect to the set-up plane. Alternatively, the slide can be adjusted on a toothed rack by means of a toothed drive, for example.

A control system is expediently provided for controlling the mandrel support device in such a manner that the mandrel support follows a circular path of the mandrel over at least a partial circular section during the winding process.

The object underlying the disclosure is further achieved by a method for winding strips, in particular metal strips into a coil or bundle, by means of a reversing reel with a rotor, on which at least one reel mandrel, provided with a rotary drive, for winding strip is arranged eccentrically with respect to an axis of rotation of the rotor, having at least one driven mandrel support device, comprising a mandrel support that has a bearing head for supporting a free end of the at least one reel mandrel, wherein the method has the following steps: Rotating the rotor to transfer the initially empty reel mandrel to an initial-winding position, supporting a free end of the reel mandrel with the bearing head of the mandrel support, lifting the free end of the reel mandrel with the mandrel support, initial-winding the strip in the initial-winding position, rotating the rotor to transfer the reel mandrel with the wound-on coil into a final-winding position, wherein the mandrel support is tracked during rotation of the rotor from the initial-winding position into the final-winding position in such a manner that the bearing head remains in load-bearing engagement with the free end of the mandrel support, supporting the reel mandrel by means of a stationary outer bearing and final winding of the strip. An adjustment of the inclination of the mandrel support before and/or during the initial winding and/or during the transfer of the reel mandrel into the final-winding position is effected in such a manner that the angle between the mandrel support and a perpendicular corresponds to the angle between a resultant force from a strip tensile force and weight force of the coil.

It is expedient to adjust the inclination of the mandrel support during the rotation of the rotor from the initial-winding position into the final-winding position.

Preferably, the tracking movement of the mandrel support is performed at least partially by superimposing a linear movement of the mandrel support device with a pivoting movement of the mandrel support. If the first, second and third piston-cylinder arrangements of the reversing reel are each provided with displacement sensors, the cylinders can be controlled in such a manner that they follow the circular path of the reel mandrel.

In an advantageous variant of the method, it is provided that the free end of the reel mandrel is supported as a function of the weight force of the coil and/or the strip tension. In this case, the load support of the mandrel support can be measured in engagement with the free end of the reel mandrel, wherein the support force of the mandrel support is controlled to compensate for its lowering caused by weight force and strip tension. For this purpose, the first piston-cylinder arrangement is preferably force-controlled such that the free end of the reel mandrel is always lifted with the optimum supporting force.

The inclination of the first piston-cylinder arrangement can be recorded by means of displacement measurement in the cylinder or direct angle measurement.

The closed-loop control system of the inclination adjustment of the first piston-cylinder arrangement can take place as a function of a force acting at an angle with respect to the supporting force of the mandrel support. If the mandrel support is loaded only in its longitudinal direction, no transverse force and therefore no torque acts on the mandrel support. The closed-loop control system can provide that the inclination of the mandrel support is adjusted in such a manner that the force acting on it at an angle to the support direction is minimal.

According to a variant of the closed-loop control of position and inclination of the mandrel support, it can be provided to provide a pure position control.

Alternatively, the closed-loop control of the position and inclination of the mandrel support can take place predominantly as force control.

Regardless of whether the closed-loop control is force control or position control, the target inclination and the target position of the mandrel support can be specified by a rotary encoder on the rotor. The closed-loop controls can alternatively take place as a function of the location of the reel mandrel.

With a variant of the method, it is provided that the supporting force acting on the mandrel support is used as an input variable of an actuator in a control loop.

In addition, the support force acting on the mandrel support can be used as an input variable of an actuator in a control loop, which serves to control the flatness of the strip.

BRIEF DESCRIPTION OF THE DRAWINGS

The invention is described below with reference to the accompanying drawings. The drawings show the following.

DETAILED DESCRIPTION

Figure 1:
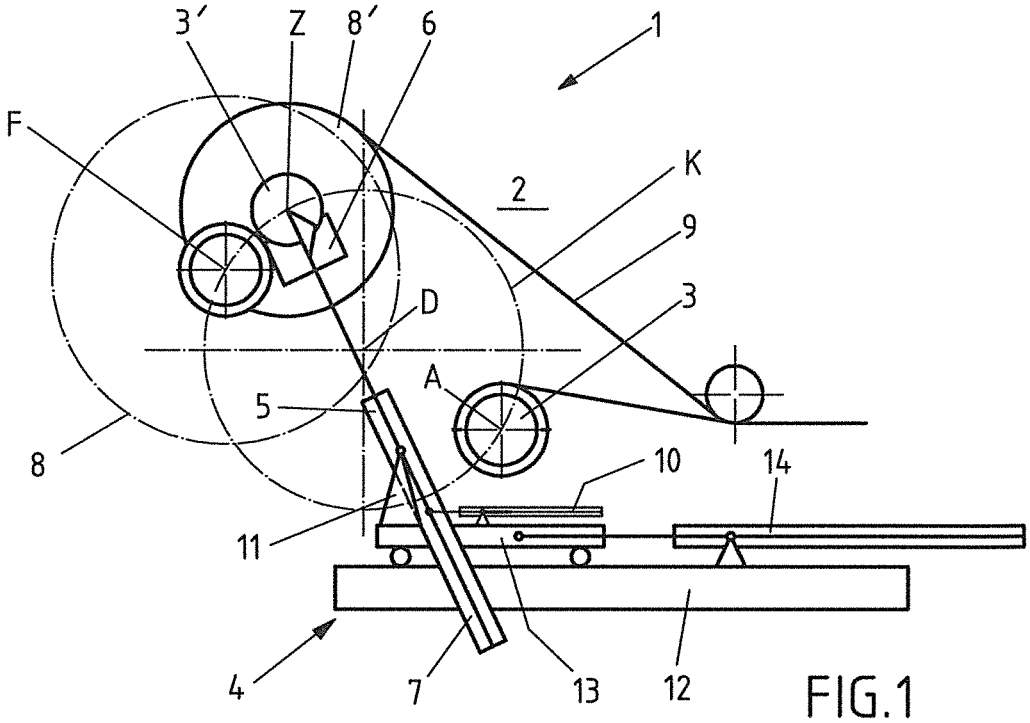
FIG. 1 is a schematic representation of a reversing reel.

FIG. 1 shows a highly simplified and schematized representation of a reversing reel 1. The reversing reel comprises a rotor 2, which can be formed as a rotating disk, for example, to which two reel mandrels 3 are fastened eccentrically with respect to an axis of rotation D of the rotor 2. The two reel mandrels 3 extend in a manner perpendicular to the plane of the rotor 2 and are each rotatably driven.

The reversing reel 1 comprises a mandrel support device 4 with a mandrel support 5, at the free end of which is a bearing head 6 formed in a fork shape. The mandrel support 5 is part of a first piston-cylinder arrangement 7, which can be adjusted longitudinally by hydraulics. In the position of the rotor 2 shown, the lower reel mandrel 3 is in the initial-winding position A and the upper reel mandrel 3 is shown in the final-winding position F. The reel mandrel 3 located in the initial-winding position A is empty. Furthermore, the drawing shows the supported position of the reel mandrel 3' in operation as an intermediate position Z from an initial-winding position A into the final-winding position F. The coil 8' shown in the intermediate position Z is already wound on. The reel mandrel 3, which is in the final-winding position F, is loaded with a final-wound coil 8, wherein the coil 8 in the final-winding position F is indicated as a dashed line. The intermediate position Z shows an arbitrary position of the reel mandrel 3 with an arbitrarily wound strip 9 during its transfer from the initial-winding position A into the final-winding position F. The intermediate position Z is not a discrete position of the rotor 2.

The mandrel support 5 is adjustable in its inclination by means of a second piston-cylinder arrangement 10. The mandrel support 5 is mounted via a mandrel-support bearing 11 on a slide 13 that can be moved horizontally and on a flat support 12. The slide 13 is in turn driven or movable, as the case may be, by means of a third piston-cylinder arrangement 14. By means of a superimposed movement of the slide 13, which is movable tangentially to the axis of rotation D of the rotor 2, and the angular adjustment of the mandrel support 5, which is effected via the second piston-cylinder arrangement 10, which mandrel support is in turn formed as a first piston-cylinder arrangement 7 adjustable in length, the bearing head 6 of the mandrel support 5 in engagement with the reel mandrel 3 in operation can follow the circular path of the reel mandrel mounted eccentrically on the rotor 2 from the initial-winding position A via the intermediate position Z into the final-winding position F, wherein, as already noted above, the intermediate position Z is only drawn for reasons of clarity. This intermediate position Z is not a discrete position of the rotor 2.

In the initial-winding position A, the reel mandrel 3 is initially raised, then the strip 9 is wound onto the reel mandrel 3. After about one to three windings, the rotary motion of the rotor 2 is started. The rotor 2 rotates the reel mandrel 3 when it is in operation, while it continues to wind the strip 9 into the final-winding position F. In the final-winding position F, a stationary outer bearing is pivoted against the reel mandrel 3, such that it engages under the reel mandrel 3. The stationary outer bearing is not shown in the drawings. The bearing head 6 of the mandrel support 5 is formed in a fork shape and engages under the reel mandrel only on a partial circle section of its circumference. A bearing head of the stationary outer bearing is formed accordingly and also engages under the reel mandrel 3 only on a partial circle circumference, in such a manner that, initially in the final-winding position F, the reel mandrel 3 is engaged under on the same length section both by the bearing head of the stationary outer bearing and by the bearing head 6 of the mandrel support 5. As soon as the reel mandrel is supported on the stationary outer bearing, the bearing head 6 of the mandrel support 5 is disengaged from the reel mandrel 3, such that the mandrel support device can be returned to its starting position.

The first, second and third piston-cylinder arrangements 7, 10 and 13 are each provided with force and/or displacement sensors. Alternatively or additionally, the first piston-cylinder arrangement 7 can be provided with an angle sensor/inclinometer/inclination sensor.

The mandrel support 5, which is already brought into engagement with the free end of the reel mandrel 3 in the initial-winding position A, is provided to travel along with or follow, as the case may be, the rotor 2 in support of the reel mandrel 3 in operation with a corresponding rotation of the rotor 2. Initially, the mandrel support 5 already raises the empty reel mandrel 3 into the initial-winding position A, in such a manner that compensation is provided for any undesirable deflection or bending, as the case may be.

Different variants are possible for controlling the position and inclination of the mandrel support 5.

For example, the inclination and position of the mandrel support 5 are specified as target values by a rotary encoder on the rotor 2, which is not shown. Alternatively, it is possible to specify the target inclination and the target position of the mandrel support 5 as a function of the position of the reel mandrel 3 in operation. Alternatively or additionally, the target inclination and the target position of the mandrel support 5 can be specified by a flatness measurement of the strip 9.

Via a control system the mandrel support 5 is driven into the corresponding target position and target inclination. The angle of inclination of the mandrel support 5 can be recorded, for example, via a displacement measurement in the cylinder of the first piston-cylinder arrangement 7 or via an angle measuring device.

Pure position control can be provided for the first, second and third piston-cylinder arrangements 7, 10, 14. The forces of all cylinders can be recorded by means of force sensors and compared with the forces that are calculated or predetermined, as the case may be. Alternatively, it is possible to adjust the first and second piston-cylinder arrangements 7, 10 by force control, whereas the third piston-cylinder arrangement 14 is moved by path-dependent closed-loop control.

Figure 2:
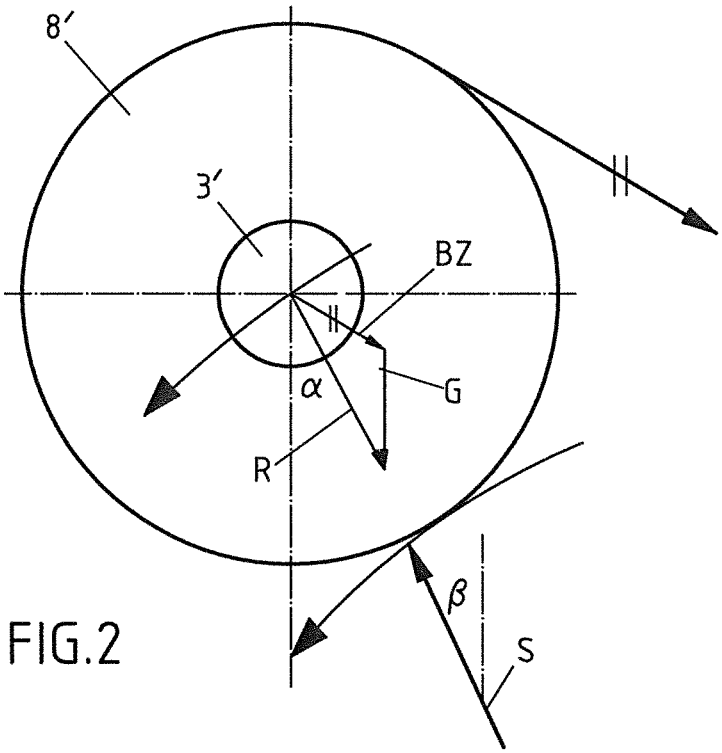
FIG. 2 is an enlarged detailed view II from FIG. 1, in which the forces acting on the reel mandrel are shown.

The circular path of the reel mandrels 3, which they complete with the rotor 2, on which they are mounted eccentrically with respect to the axis of rotation D, is marked with the letter K. The inclination of the mandrel support 5 is adjusted during the operation of the supported holding mandrel 3, such that the angle between the relevant mandrel support 3 and a perpendicular corresponds as far as possible to the angle between a resultant force R from a strip tensile force BZ and the weight force G of the coil 8, 8'. A graphical force decomposition of the resultant force R from the strip tensile force BZ and the weight force G of the coil 8, 8' is shown in FIG. 2.

With the method in accordance with the disclosure, as already mentioned at the beginning, the reel mandrel 3 to be loaded is first brought into the initial-winding position A. In such initial-winding position A, the free end of the reel mandrel 3 is supported or gripped, as the case may be, by the correspondingly moved mandrel support 5 with the bearing head 6 formed in the shape of a fork. The mandrel support 6 then raises the reel mandrel 3 to a position in which bending or deflection, as the case may be, of the reel mandrel 3 is largely counteracted. In the initial-winding position A, two to three windings of the strip 9 are initially wound onto the reel mandrel 3. Then, the rotor 2 of the reversing reel 1 is turned counterclockwise in accordance with the representation in FIGS. 1 and 2. After the coil 8 has been initially wound, the reel mandrel 3 in question is transferred into the final-winding position F by rotating the rotor 2 while maintaining the strip tension BZ. As a result of the winding process, the weight of the coil 8 increases continuously, and the angle of the resulting R from the strip tensile force BZ and the weight force G of the coil 8 changes continuously. The support force S of the mandrel support 5, for example, is always adjusted by means of a closed-loop control system and a control system in such a manner that deflection of the mandrel support 3 is counteracted accordingly at all times. As mentioned above, the closed-loop control system of the support force S of the mandrel support 5 is only one of several variants for controlling the position and inclination of the mandrel support 5. During the rotary motion of the rotor 2, the inclination of the mandrel support 5 and the horizontal position of the slide 13 in relation to the set-up plane in the exemplary embodiment are set or preset, as the case may be, in such a manner that the inclination of the mandrel support 5 and consequently the direction of action of the supporting force S is oriented essentially opposite to the resulting R from the strip tensile force BZ and the weight force G of the coil 8. The mandrel support 5 is thus oriented parallel to the effective direction of the resulting R from the strip tensile force BZ and the weight force G. As can be seen from FIG. 2, the angle α between R and a perpendicular corresponds to the angle β between S and a perpendicular.

The force control of the mandrel support 5 can, for example, be carried out in such a manner that the support force S is determined via the cylinder pressure of the first piston-cylinder arrangement. All cylinders or piston-cylinder arrangements 7, 10, and 13, as the case may be, are provided with path sensors with which the position and inclination of the mandrel support can be reliably recorded.

Figure 3:
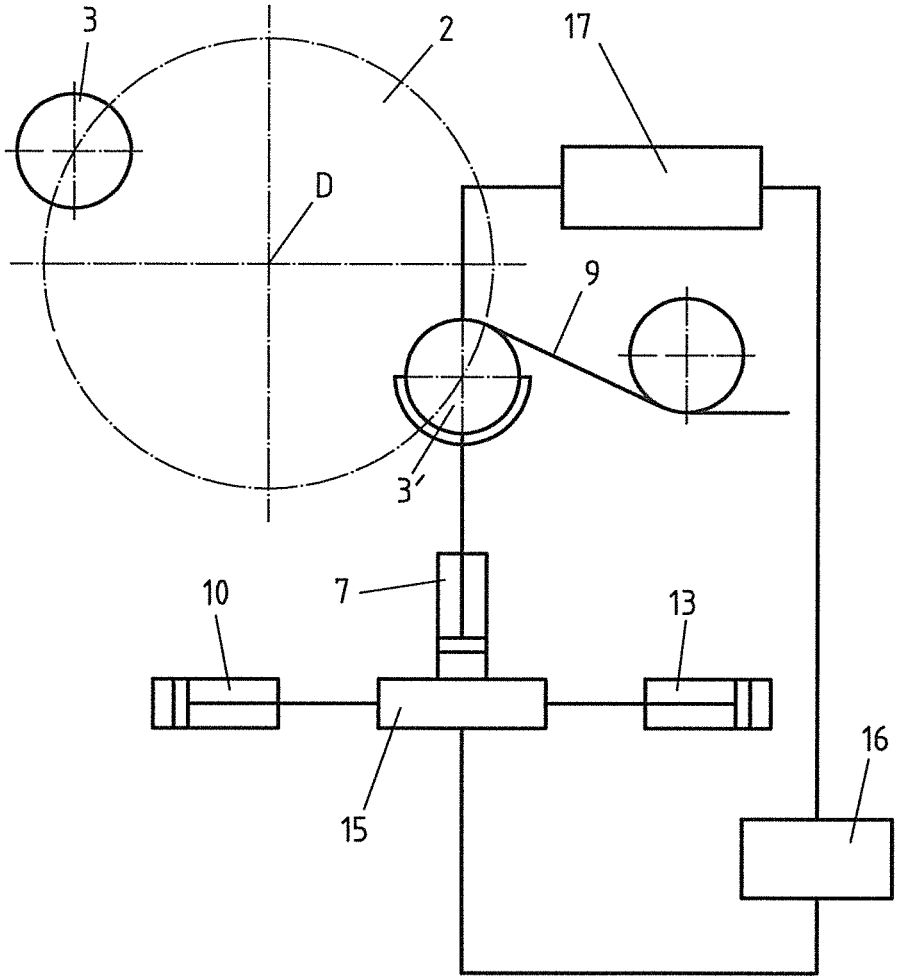
FIG. 3 is a control diagram, in which the deflection of the reel mandrel is shown as an actuator in a separate closed-loop control system.

FIG. 3 shows a control diagram in which the position of the reel mandrel 3 and the deflection of the reel mandrel 3 are used as an actuator 15 in a control loop with a controller 16. The positions of the respective cylinders or piston-cylinder arrangements 7, 10, 13, as the case may be, along with the data obtained via the cylinder pressure of the first piston-cylinder arrangements 7 and the data of a position sensor 17 for recording the position of the reel mandrel 3 are processed in the controller 16 for controlling the inclination and position of the mandrel support 5.

Figure 4:
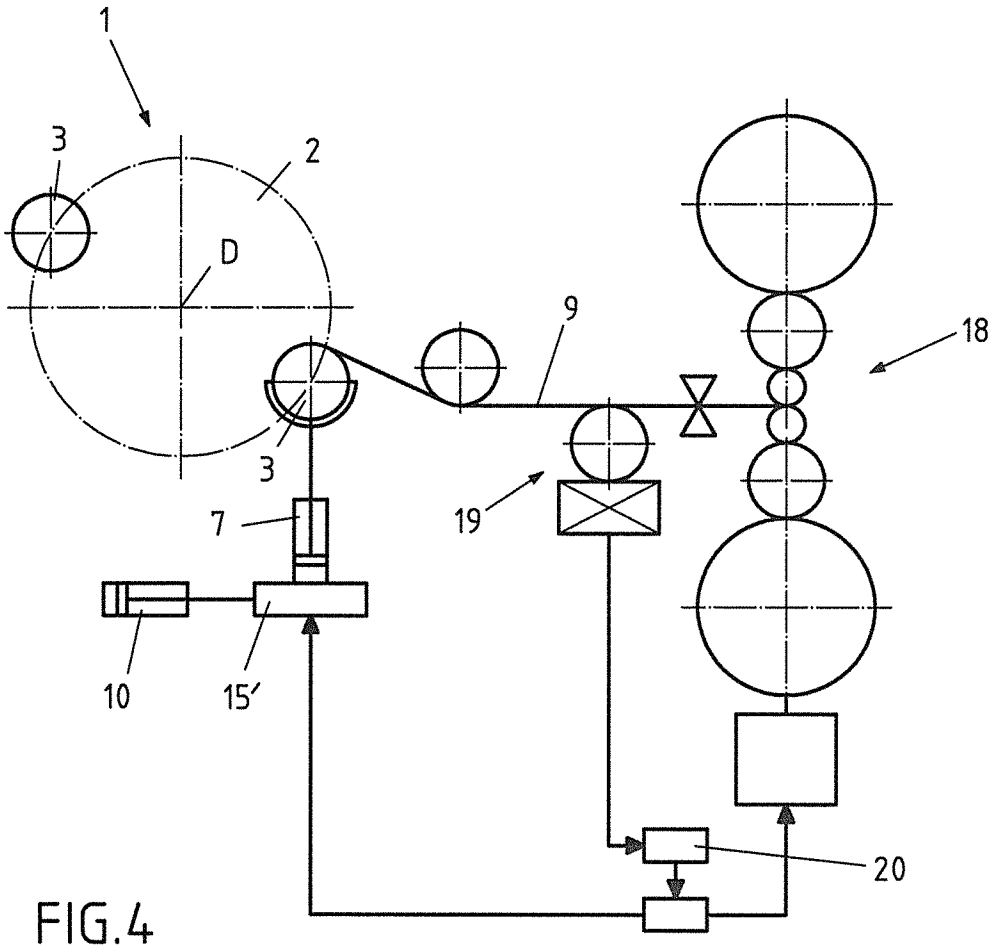
FIG. 4 is a control diagram, in which the deflection of the reel mandrel is shown as an actuator of a flatness control for the strip.

FIG. 4 shows a control diagram in which the deflection of the reel mandrel 3 is used as an actuator 15' of a closed-loop control system for the flatness of the strip during the winding process. The reference sign 18 indicates a stand of a rolling mill with which the flatness of the strip 9 can be influenced. The control loop includes a flatness measurement 19 of the strip 9, the measured values of which are processed together with the values from the actuator 15' in a flatness controller 20.

LIST OF REFERENCE SIGNS

1 Reversing reel
2 Rotor
3, 3' Reel mandrels
4 Mandrel support device
5 Mandrel support
6 Bearing head
7 First piston-cylinder arrangement
8, 8' Coil
9 Strip
10 Second piston-cylinder arrangement
11 Mandrel-support bearing
12 Support
13 Slides
14 Third piston-cylinder arrangement
15 Actuator
16 Controller
17 Position sensor
18 Stand
19 Flatness measurement
20 Flatness controller
A Initial-winding position
F Final-winding position
Z Intermediate position
BZ Strip tensile force
G Weight force of the coil
D Rotational axis of the rotor
K Circular path of reel mandrels
S Support force
α Angle
β Angle

The invention claimed is:

1. A reversing reel (1), comprising:

a rotor (2);

a reel mandrel (3), provided with a rotary drive, for winding strip (9) into a coil (8), the reel mandrel (3)

being arranged on the rotor (2) eccentrically with respect to an axis of rotation (D) of the rotor (2); and a driven mandrel support device (4) having a mandrel support (5) that has a bearing head (6) for supporting a free end of the reel mandrel (3), wherein the bearing head (6) is movable with the reel mandrel (3), in accordance with a variable position of the reel mandrel (3), when the reel mandrel (3) is transferred from an initial-winding position (A) into a final-winding position (F), wherein the mandrel support (5) is a first piston-cylinder arrangement (7) and the mandrel support (5) is supported in a pivotable manner via a mandrel-support bearing (11) on a slide (13) that is movable tangentially to a circular path of the reel mandrel (3), and wherein an inclination of the mandrel support (5) and a position of the bearing head (6) are adjustable such that the mandrel support (5) is oriented in accordance with a resultant force R from a weight force of the coil (8) and a tensile force on the strip (9).

2. The reversing reel according to claim 1, further comprising an adjusting device fastened on the slide (13) for adjusted the inclination of the mandrel support (5).

3. The reversing reel according to claim 1, further comprising a second piston-cylinder arrangement (10) as an adjusting device for adjusting the inclination of the mandrel support (5).

4. The reversing reel according to claim 1, further comprising a hydraulic or electric rotary drive as an adjusting device for adjusting the inclination of the mandrel support (5).

5. The reversing reel according to claim 1, wherein the slide (13) is displaceable tangentially to the axis of rotation (D) of the rotor (2) via a third piston-cylinder arrangement (14).

6. The reversing reel according to claim 1, further comprising a closed-loop control system with which the mandrel support device (4) is controlled in such a manner that the mandrel support (5) follows a circular path of the reel mandrel (3) over at least a partial circular section during a winding process.

7. A method for winding a metal strip into a coil (8), comprising:

providing a reversing reel with a rotor (2), the rotor (2) having a reel mandrel (3), provided with a rotary drive, for winding the metal strip (9) arranged eccentrically with respect to an axis of rotation (D) of the rotor (2), and a driven mandrel support device (4), comprising a mandrel support (5) that has a bearing head (6) for supporting a free end of the reel mandrel (3);

rotating the rotor (2) to transfer reel mandrel (3) while being initially empty to an initial-winding position (A);

supporting a free end of the reel mandrel (3) with the bearing head (6) of the mandrel support (5);

lifting the free end of the reel mandrel (3) with the mandrel support (5);

initially winding the metal strip (9) in the initial-winding position (A);

rotating the rotor (2) to transfer the reel mandrel (3) with an initially wound-on coil (8) into a final-winding position (F), wherein the mandrel support (5) is tracked during a rotation of the rotor (2) from the initial-winding position (A) into the final-winding position (F) in such a manner that the bearing head (6) remains in load-bearing engagement with the free end of the mandrel support (5); and supporting the reel mandrel by a stationary outer bearing and final winding the metal strip (9), wherein an adjustment of an inclination of the mandrel support (5) before and/or during the initial winding and/or during the transfer of the reel mandrel (3) into the final-winding position (F) is effected in such a manner that an angle between the mandrel support (5) and a perpendicular essentially corresponds to an angle between a resultant force (R) from a strip tensile force (BZ) and weight force (G) of the coil (8).

8. The method according to claim 7, wherein the adjustment of the inclination of the mandrel support (5) takes place during the rotation of the rotor (2) from the initial-winding position (A) into a final-winding position (F).

9. The method according to claim 7, wherein the tracking of the mandrel support (5) is performed at least partially by superimposing a linear movement of the mandrel support device (4) with a pivoting movement of the mandrel support (5).

10. The method according to claim 7, wherein the free end of the reel mandrel (3) is supported as a function of the weight force (G) of the coil (8) and/or the strip tensile force.

11. The method according to claim 10, wherein the load support of the mandrel support (5) is measured in engagement with the free end of the reel mandrel (3) and wherein the support force (S) of the mandrel support (5) is controlled such that compensation is provided for its lowering caused by weight force (G) and strip tensile force (BZ).

12. The method according to claim 10, wherein the supporting force (S) acting on the mandrel support (3) is used as an input variable of an actuator in a control loop.

13. The method according to claim 10, wherein the supporting force (S) acting on the mandrel support (3) is used as input variable of an actuator in a control loop provided for controlling a flatness of the metal strip (9).

* * * * *